US005217837A

United States Patent [19]

Henry et al.

[11] Patent Number: 5,217,837

[45] Date of Patent: Jun. 8, 1993

[54] MULTILAYERED FUSER MEMBER

[75] Inventors: Arnold W. Henry, Pittsford; Patrick J. Finn, Webster; George J. Heeks, Rochester; Robert N. Finsterwalder; George A. Riehle, both of Webster; William J. Cheslock, Marion, all of N.Y.

[73] Assignee: Xerox Corporation, Stamford, Conn.

[21] Appl. No.: 755,274

[22] Filed: Sep. 5, 1991

[51] Int. Cl.[5] ..... G03G 13/20

[52] U.S. Cl. ..... 430/124; 430/99; 355/284; 428/339; 428/447; 428/448

[58] Field of Search ..... 430/99, 124; 355/284; 428/339, 448, 447

[56] References Cited

U.S. PATENT DOCUMENTS

| | | | |
|---|---|---|---|
| 4,029,827 | 6/1977 | Imperial et al. | 427/22 |
| 4,101,686 | 7/1978 | Strella et al. | 427/22 |
| 4,185,140 | 1/1980 | Strella et al. | 428/418 |
| 4,257,699 | 3/1981 | Lentz | 355/3 FU |
| 4,264,181 | 4/1981 | Lentz et al. | 355/3 FU |
| 4,272,179 | 6/1981 | Seanor | 355/3 FU |
| 4,323,603 | 4/1982 | Close | 524/545 |
| 5,017,432 | 5/1981 | Eddy et al. | 428/422 |
| 5,049,444 | 9/1991 | Bingham et al. | 428/339 |
| 5,061,965 | 10/1991 | Ferguson et al. | 355/284 |

*Primary Examiner*—Marion E. McCamish
*Assistant Examiner*—Rosemary Ashton

[57] ABSTRACT

A multilayered fuser member for fusing thermoplastic resin toner images to a substrate in a fuser system of the type wherein a polymeric release agent having functional groups is applied to the surface of the fuser member, the fuser member has a base support member, a thermally conductive silicone elastomer layer, an amino silane primer layer, an adhesive layer and an elastomer fusing surface comprising poly(vinylidenefluoride-hexafluoropropylene-tetrafluoroethylene) a metal oxide present in the fusing surface to interact with the polymeric release agent to provide an interfacial barrier layer between the fusing surface and the toner and substantially unreactive with the elastomer, the elastomer having been cured from a solvent solution with a nucleophilic curing agent soluble in the solution and in the presence of 4 parts by weight of inorganic base per 100 parts of polymer, the adhesive layer having been cured from a solvent solution of the above composition from which the fusing surface is cured and from about 5 to about 10% by weight of a coupling agent represented by the formula:

where R can be an alkyl having 1 to 4 carbon atoms; R′ can be an alkyl group having 1 to 7 carbon atoms; R″ can be H, R or the acyl radical, X is a vinyl group or an alkenyl group or an alkyl, having 1 to 4 carbon atoms, substituted alkenylcarboxy group of less than 8 carbon atoms; and q is 1 or 2, k is 0 to 3, b is 0 to 2, a is 0 or 1, p is 0 to 20 and k+b+a=3.

20 Claims, 1 Drawing Sheet

MULTILAYERED FUSER MEMBER

CROSS REFERENCE TO RELATED APPLICATIONS

Reference is hereby made to copending application Ser. No. 07/451,056 now U.S. Pat. No. 5,049,444 filed Dec. 15, 1989 entitled "Silane Adhesive System For a Fuser Member" in the name of Bingham et al. and commonly assigned to the assignee of the present invention.

BACKGROUND OF THE INVENTION

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well know. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, the thermoplastic resin particles are fused to the substrate by heating to a temperature of between about 90° Centigrade to about 160° C. or higher depending upon the softening range of the particular resin used in the toner. It is undesirable, however, to raise the temperature of the substrate substantially higher than about 200° C. because of the tendency of the substrate to discolor at such elevated temperatures particularly when the substrate is paper.

Several approaches to thermal fusing of electroscopic toner images have been described in the prior art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles is well known in the art, and they can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip effects the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus increasing the background or interfering with the material being copied there. The so called "hot offset" occurs when the temperature of the toner is raised to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface which has a low surface energy to provide the necessary release. To insure and maintain good release properties of the fuser roll, it has become customary to apply release agents to the fuser members to insure that the toner is completely released from the fuser roll during the fusing operation. Typically, these materials are applied as thin films of, for example, silicone oils to prevent toner offset.

PRIOR ART

Some recent developments in fuser members, release agents and fusing systems are described in U.S. Pat. No. 4,264,181 to Lentz et al., U.S. Pat. No. 4,257,699 to Lentz and U.S. Pat. No. 4,272,179 to Seanor, all commonly assigned to the assignee of the present application. These patents describe fuser members and methods of fusing thermoplastic resin toner images to a substrate wherein a polymeric release agent having functional groups is applied to the surface of the fuser member. The fuser member comprises a base member having an elastomeric surface with a metal containing filler therein which has been cured with a nucleophilic addition curing agent. Exemplary of such fuser member is an aluminum base member with a poly(vinylidenefluoride-hexafluoropropylene) copolymer cured with bisphenol curing agent having lead oxide filler dispersed therein and utilizing a mercapto functional polyorganosiloxane oil as a release agent. In those fusing processes, the polymeric release agents have functional groups (also designated as chemically reactive functional groups) which interact with the metal containing filler dispersed in the elastomer or resinous material of the fuser member surface to form a thermally stable film which releases thermoplastic resin toner and which prevents the thermoplastic resin toner from contacting the elastomer material itself. The metal oxide, metal salt, metal alloy or other suitable metal compound filler dispersed in the elastomer or resin upon the fuser member surface interacts with the functional groups of the polymeric release agent. Preferably, the metal containing filler materials do not cause degradation of or have any adverse effect upon the polymeric release agent having functional groups. Because of this reaction between the elastomer having a metal containing filler and the polymeric release agent having functional groups, excellent release and the production of high quality copies are obtained even at high rates of speed of electrostatographic reproducing machines.

While the mechanism involved is not completely understood, it has been observed that when certain polymeric fluids having functional groups are applied to the surface of a fusing member having an elastomer surface with a metal oxide, metal salt, metal, metal alloy or other suitable metal compounds dispersed therein there is an interaction (a chemical reaction, coordination complex, hydrogen bonding or other mechanism) between the metal of the filler in the elastomer and the polymeric fluid having functional groups so that the polymeric release agent having functional groups in the form of a liquid or fluid provides an excellent surface for release having an excellent propensity to remain upon the surface of the fuser member. Regardless of the mechanism, there appears to be the formation of a film upon the elastomer surface which differs from the composition of the elastomer and the composition of the polymeric release agent having functional groups. This film, however, has a greater affinity for the elastomer containing a metal compound than the toner and thereby provides an excellent release coating upon the elastomer surface. The release coating has a cohesive force which is less than the adhesive forces between heated toner and the substrate to which it is applied and the cohesive forces of the toner. The interaction between the functional group of the polymeric release agent and the metal of the elastomer containing metal leads to an overall diminution of the critical or high surface energy of the metal in the metal containing filler. The use of polymeric release agents having functional groups which interact with a fuser member to form a thermally stable, renewable self-cleaning layer having superior release properties for electroscopic thermoplastic resin toners is described in U.S. Pat. Nos. 4,029,827 to Imperial et al., 4,101,686 to Strella et al. and 4,185,140 also to Strella et al., all commonly assigned to the assignee of the present invention. In particular, U.S. Pat. No. 4,029,827 is directed to the use of polyorganosiloxanes having mercapto functionality as release agents. U.S. Pat. Nos. 4,101,686 and 4,185,140 are directed to polymeric release agents having functional groups such as carboxy, hydroxy, epoxy, amino, isocyanate, thioether and mercapto groups as release fluids.

The preferred elastomers for the fuser members are the fluoroelastomers and the most preferred fluoroelastomers are the vinylidenefluoride base fluoroelastomers which contain hexafluoropropylene and tetrafluoroethylene as comonomers. Several of these fusing systems having enjoyed significant commercial application. For example, a fuser roll as described in U.S. Pat. No. 5,017,432 to Eddy et al. has been successfully used in a fusing system employing a mercapto functional polyorganosiloxane release agent. Therein described is a fuser member having a long life with reduced levels of functional release agent which is resistant to attack by the charge control agent DDAMS and which is achieved by controlling the vinylidenefluoride content of the poly(vinylidenefluoride-hexafluoropropylene-tetrafluoroethylene) so as to provide a balance between a polymer which is as completely fluorinated as possible but still can be adequately cross linked. In addition, a metal oxide filler is selected and provided in an amount sufficient to interact with a polymeric release agent having functional groups to provide the interfacial barrier layer between the fusing surface and the substrate and one which is substantially unreactive with elastomer thereby avoiding subsequent hardening and an increase in surface energy resulting in decrease in release properties. Furthermore, by curing the poly(vinylidenefluoride-hexafluoropropylene-tetrafluoroethylene) at relatively low base levels with a nucleophilic curing agent soluble in a solvent solution of the polymer, the amount of inorganic base provided is sufficient to generate active sites for cross linking but not sufficient for subsequent dehydrofluorination of the vinylidenefluoride to generate additional active sites which will result in hardening of the fuser member.

In a typical application of the fusing system described in U.S. Pat. No. 5,017,432 the elastomer fusing surface of the poly(vinylidenefluoride-hexafluoropropylene-tetrafluoroethylene) which may be Viton TM GF available from E.I. DuPont de Nemours, Inc. is applied as a relatively thin layer over a relatively thicker layer of a thermally conductive HTV silicone elastomer on a cylindrical core supporting substrate. While sometimes capable of performing adequately as a fuser member for an adequate period of time it has been determined that such a fuser member eventually suffers from failure by delamination of the fluoroelastomer from the silicone elastomer at an unpredictable period of use or time. For example, failure can be experienced at time $T_o$ after manufacture merely by manually peeling the fluoroelastomer layer from the underlying silicone layer. Although fuser member life up to 90,000 copies has been achieved, this is rare as such fuser members typically fail by delamination at an average of about 20,000 copies with pieces or chunks of fluoroelastomer of the order of 0.020 to 0.25 inch in dimension coming off or a partial ring debonding around the fuser roll from the silicone elastomer occurring. It is believed that these failures are in part caused by the processing conditions, particularly relative humidity, during manufacture as well as the environment in which the fuser member is used. It is believed, for example, that the manufacture of such fuser members in a relative humidity environment at a certain level, 80% for example, contributes to delamination. It is further believed that the delamination is caused in part by the charge enhancing additive disteryl dimethyl ammonium methyl sulfate (DDAMS) as discussed in the above-referenced Eddy et al. U.S. Pat. No. 5,017,432 which it is believed defuses through the fluoroelastomer layer and degrades the bonding interface between the fluoroelastomer layer and silicone elastomer layer.

SUMMARY OF THE INVENTION

In accordance with the principle aspect of the present invention, we have found a unique combination of a primer layer and an adhesive layer when used in the manufacture of a fuser member having a thermally conductive silicone elastomer layer overcoated with the fluoroelastomer layer that dramatically improves the bonding between the silicone elastomer and the fluoroelastomer and reduces the failure rate by delamination or debonding to an acceptable level even when the member is manufactured or used in a high relative humidity environment or used in a fusing system where the toner contains the charge control agent DDAMS.

In a further aspect of the present invention, a multilayered fuser member for fusing thermoplastic resin toner images in a fusing system of the type wherein polymeric release agents having functional groups is supplied to the surface of the fuser member comprises a base support member, a thermally conductive silicone elastomer layer, an amino silane primer layer, an adhesive layer and an elastomer fusing surface of a poly(vinylidenefluoride-hexafluoropropylene-tetrafluoroethylene) where the vinylidenefluoride is present in an amount less than 40 mole percent and a metal oxide is present in an amount sufficient to interact with a polymeric release agent having functional groups to provide an interfacial barrier layer between the fusing surface and the toner and which is substantially unreactive with the elastomer, the elastomer having been cured from a solvent solution thereof with a nucleophilic curing agent soluble in the solution and in the presence of less than 4 parts by weight of inorganic base per hundred parts of polymer, the inorganic base being effective to at least partially dehydrofluorinate the vinylidenefluoride and the adhesive layer is cured from a solvent solution of the composition from which the fusing surface is cured and from about 5 to about 20 percent by weight of that composition of a coupling agent represented by the formula:

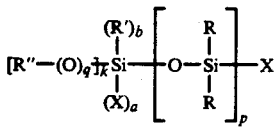

where R can be an alkyl group having 1 to 4 carbon atoms; R′ can be an alkyl group having 1 to 7 carbon atoms; R″ can be H, R or the (acyl) radical,

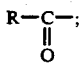

X is a vinyl group or an alkenyl group of 3 to 8 carbon atoms, or an alkyl, 1 to 4 carbon atoms, substituted alkenylcarboxy group of less than 8 carbon atoms; q is 1 or 2, k is 0 to 3, b is 0 to 2, a is 0 or 1, p is 0 to 20 and $k+b+a=3$.

In a further aspect of the present invention the amino silane is represented by the formula:

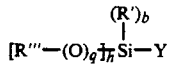

where R′ can be an alkyl group having 1 to 7 carbon atoms, R‴ can be an alkyl group having 1 to 7 carbon atoms or a polyalkoxyalkyl group of less than 7 carbon atoms and Y is an amino group or an amino substituted alkyl, or a polyamino substituted alkyl, or an alkenylalkoxy amino, or an aryl amino group of less than 15 carbon atoms and h is 1 to 3, b is 0 to 2, q is 1 or 2 and $h+b=3$.

In a further aspect of the present invention the amino silane is gamma-aminopropyltriethoxysilane.

In a further aspect of the present invention the amino silane primer is applied to the silicone elastomer by means of a brush, dipping or spraying.

In a further aspect of the present invention the coupling agent is a silicone with vinyl functionality such as Dow Corning 3-6060 which is believed to contain an acetoxysiloxane, ethylpolysilicate and an organo titanium compound.

In a further aspect of the present invention the adhesive layer is from about 5 to about 30 micrometers thick and the fusing surface layer is from about 30 to about 65 micrometers thick.

In a further aspect of the present invention the inorganic base is magnesium oxide which is present in an amount of about 2 parts by weight per 100 parts of polymer.

In a further aspect of the present invention the silicone elastomer is a cured polydimethyl siloxane having the formula:

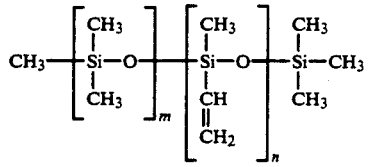

where $0<(n/m)\leqq 0.2$ and $m+n$ is 3,000 to 10,000.

Other features of the present invention will become apparent as the following description proceeds and upon reference to the drawings.

DETAILED DESCRIPTION OF THE PRESENT INVENTION

Figure 1:
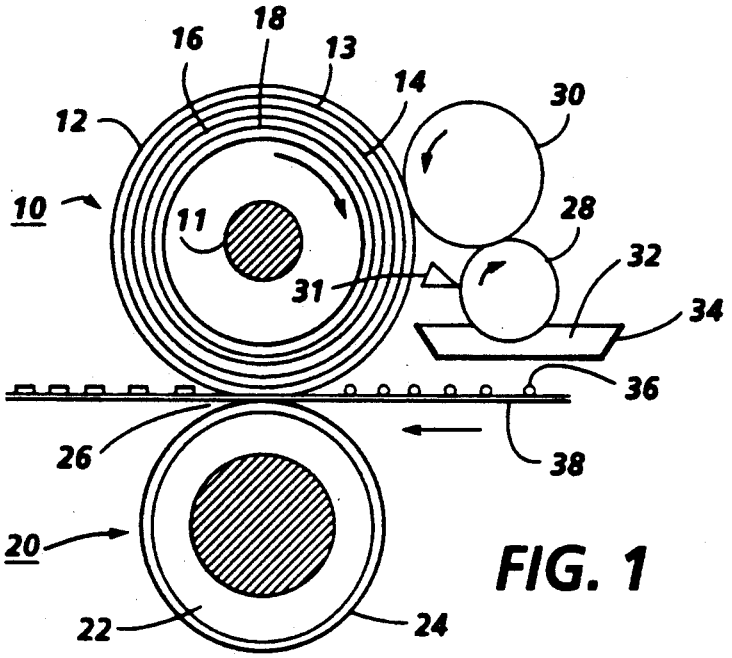
FIG. 1 is a sectional view of a fuser system which may use the fuser member of the present invention.

A typical fuser member of the present invention is described in conjunction with the fuser assembly as illustrated in FIG. 1 wherein the numeral 10 designates a multilayered fuser roll comprising in sequential order a base support member 18, a relatively thick silicone elastomer layer 16, an amino silane primer layer 14, an adhesive layer 13 and an elastomeric fusing surface 12 having metal oxide filler dispersed therein (not shown). The base support member 18 which is typically a hollow cylinder or core has suitable heating element 11 disposed in the hollow portion thereof which is coextensive with the cylinder. Backup or pressure roll 20 cooperates with the fuser roll 10 to form a fusing nip or contact arc 26 through which a copy paper or other substrate 38 passes such that toner images 36 thereon contact the elastomer fusing surface 12 of the fuser roll 10. As shown in FIG. 1, the backup roll 20 has a rigid steel core 22 with a thin Teflon, Trademark of E. I. DuPont de Nemours, Inc., surface layer 24 thereon. Sump 34 contains polymeric release agent 32 having functional groups thereon. The release agent is one having functional groups to provide an interfacial barrier layer between the fusing surface and the toner. In the embodiment shown in FIG. 1, two release agent delivery rolls 28 and 30 are provided for applying polymeric release agent 32 to the elastomer surface 12 from the sump 34. These two release agent delivery rolls are rotatably mounted in the direction indicated to transport the release agent from the sump to the elastomeric fusing surface. As illustrated in FIG. 1, roll 28 is partly immersed in the sump 34 and transports on its surface release agent from the sump to the delivery roll 30. By using a metering blade 31, a layer of polymeric release fluid can be applied initially to the delivery roll 30 and subsequently to the elastomeric fusing surface in a controlled thickness ranging from sub micron thickness to a thickness of the order of several microns of release fluid. Accordingly, by metering device 31 a layer of release fluid about 0.1 to 2 microns or greater thicknesses can be applied to the surface of elastomer fusing surface.

Figure 2:
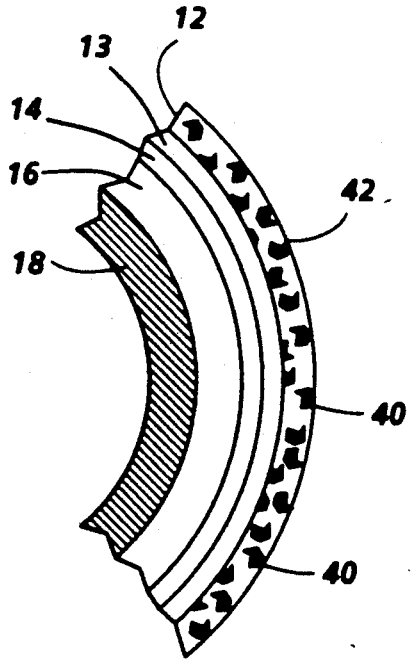
FIG. 2 is an enlarged fragmentary sectional view of one embodiment of the fuser member of the present invention.

Referring now to FIG. 2 there is shown a fragmentary view of a fuser member according to the present invention magnified many times in order to show the multilayered structure of the fuser member. In FIG. 2 the metal oxide filler particles 40 are shown as having irregular shapes, however, any form of metal oxide may be used in the elastomeric fusing surface 12, powders, platelets, spheroids, fibers, oval particles and the like. In addition, the film of polymeric release agent having functional groups is illustrated on the surface of elastomer fusing surface 12 and is designated by the reference numeral 42. The base support member may be selected from any suitable material. Typically, it may be selected from aluminum, anodized aluminum, steel, nickel, copper and the like. In a preferred embodiment it is an aluminum tube or alternatively a flame sprayed aluminum coated steel tube.

According to the present invention a multilayered fuser member is provided wherein a dramatic improvement in bonding between a fluoroelastomer fusing surface and a thermally conductive silicone elastomer layer is provided by including an amino silane primer layer on the silicone elastomer layer and an adhesive layer thereover of the fluoroelastomer and a coupling agent. In addition to providing greater resistance to delamination or debonding between two layers, the combination of the amino silane primer layer and the adhesive layer is believed to provide improved resistance to deleterious attack of the bond between the two layers by charge control agents such as DDAMS.

In a specific embodiment the amino silane primer is a gamma-aminopropyltriethoxy silane such as that available from Union Carbide under the designation Union Carbide Organofunctional silane A-1100 and the coupling agent used in the adhesive composition is a silicone with vinyl functionality such as Dow Corning 3-6060 which is believed to contain acetoxysiloxane ethylpolysilicate and an organo titanium compound. The silicone elastomer layer is filled with conductive particles, filler materials such as silica, alumina, boron nitride and the like as is well known in the art to provide a thermally conductive layer that conducts heat from the heating element through the layer to the thinner fusing surface layer. This separate, relatively thick silicone elastomer layer is used rather than a single fluoroelastomer layer since it may be filled to a greater degree than the fluoroelastomer layer and thereby provide a more thermally conductive layer without undo hardness having a Durometer of Shore A, less than 80.

Any suitable thermally conductive silicone elastomer layer may be employed. Typically it is made from peroxide curable polyorganosiloxane generally known as high temperature vulcanizates (HTV'S) which are typically polydimethylsiloxanes with pendent vinyl groups such as are illustrated by the formula:

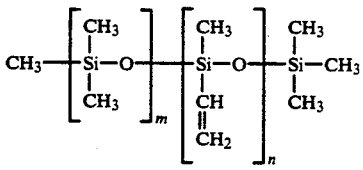

where $0<(n/m)\leqq 0.2$ and $m+n$ is 3,000 to 10,000. These materials are crosslinked at elevated temperatures of about 120° Centigrade with peroxides. As is well known in the art, a variety of groups, including trifluoropropyl, cyanopropyl, phenyl and vinyl are used to substitute for some of the methyl groups in order to impart specific cure, mechanical or chemical properties to silicone rubber. Introduction of phenyl groups reduces elasticity and increases tensile and tear strength of vulcanizates. Phenyl groups reduce vulcanization yield. Trifluoropropyl groups increase solvent resistance. Introduction of low percentages of vinyl groups reduces vulcanization temperature and imparts greater elasticity and lower compression set to rubbers. Peroxide cure gums may also be vinyldimethylsiloxy terminated. The peroxides most commonly used are benzoyl peroxide and bis(dichlorobenzoyl) peroxide. Dicumyl peroxide can be used for vinyl containing polymers. Generally, peroxide loading is 0.2 to 1.0 percent and cure is at 120°-140° C. In addition, other peroxides such 2,5 dimethyl 2,5 bis (t-butyl peroxy) hexane can be used to cross link HTV's at temperatures up to 180° C.

Typically, a layer of the HTV is applied to the core material by molding or extruding to a thickness of from about 1 millimeter to about 3 millimeters. It is typically cured for 20–30 minutes at a temperature between 120° C. to 180° C., depending on the particular peroxide employed. While the silicone elastomer may be subjected to a post cure operation, it is preferred not to do so as it is believed that a 10 to 20 percent improvement in adhesion between the silicone elastomer and fluoroelastomer layer is achieved by providing a greater interpenetration of the two elastomers without post cure treatment.

Any suitable amino silanes may be employed as the primer in the practice of the present invention. Typical amino silanes are represented by the formula:

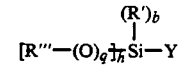

where R' can be an alkyl group having 1 to 7 carbon atoms, R''' can be an alkyl group having 1 to 7 carbon atoms or a polyalkoxyalkyl group of less than 7 carbon atoms; Y is an amino group or an amino substituted alkyl, or a polyamino substituted alkyl or an alkenylalkoxy amino or an aryl amino group of less than 15 carbon atoms and h is 1 to 3, b is 0 to 2, q is 1 or 2 and $h+b=3$.

Particularly effective materials include gamma amino propyltriethoxy silane available from Union Carbide under the product name Union Carbide Organo functional Silane A-1100 and other suitable materials include N-(2 aminoethyl-3-aminopropyl) trimethoxysilane, 6-(aminohexylaminopropyl) trimethoxysilane, p-aminophenyltrimethoxysilane, 3-(1 aminopropoxy)-3, 3-dimethyl-1-propenyltrimethoxysilane, 3-aminopropyltris(methoxyethoxyethoxy)silane and N-(2aminoethyl)-3-aminopropylmethyldimethoxy silane.

The precise manner in which the amino silane functions in improving adhesion between the silicone elastomer layer and the fluoroelastomer fusing surface is not completely understood. It is believed that the amino silane contributes to resisting attack of the bond between the silicone elastomer layer and the fluoroelastomer layer by the charge control agent DDAMS which rather quickly penetrates the fluoroelastomer layer on contact. The amino silane primer layer may be applied to the base support member in any suitable manner. While it may be sprayed on, since it is sensitive to relative humidity during processing, it is preferred to brush it from an alcohol solution thereby avoiding the necessity to atomize it and providing a more robust primer layer. Typically, the amino silane is applied in thickness from about 0.5 to 5.0 micrometers and after application is permitted to dry in an atmosphere up to 80 percent relative humidity in a clean environment.

The fluoroelastomer used as the fusing surface layer is that described in the above-referenced Eddy et al., U.S. Pat. No. 5,017,432, the disclosure which is specifically incorporated herein in it's entirety by reference and which briefly describes a fusing surface layer made from a poly(vinylidenefluoride-hexafluoropropylene-tetrafluoroethylene) wherein the vinylidenefluoride is present in an amount less than 40 mole percent. Commercially available fluoroelastomers having low quantities of vinylidenefluoride include Viton GF available from E. I. DuPont de Nemours, Inc. which has about 35 mole percent vinylidenefluoride, 34 mole percent hexafluoropropylene and 29 mole percent tetrafluoroethylene with 2 percent cure site monomer. While Viton GF is generally cured with conventional aliphatic peroxide curing agent, according to the present invention it is cured by a nucleophilic curing system in the presence of relatively low amounts of inorganic base materials. Typically, less than four parts by weight of inorganic base per hundred parts of polymer, and preferably about two parts of inorganic base per hundred parts by weight of polymer to at least particularly dehydrofluorinate the vinylidenefluoride. As further described in the Eddy et al. patent, the poly(vinylidenefluoride-hexafluoropropylene-tetrafluoroethylene) is cured with Viton Curative No. 50 available from E. I. DuPont de Nemours, Inc. which is soluble in a solvent solution of the polymer at low base levels and is readily available at the reactive sites for crosslinking. This Curative No. 50 incorporates an accelerator, a quarternary phosphonium salt or salts and a crosslinking agent, bisphenol AF, into a single curative system.

The metal oxide disbursed in the fluoroelastomer must be capable of interacting with the functional groups of the polymeric release agent to form a thermally stable film which releases the thermoplastic resin toner and prevents the toner from contacting the elastomer material itself. In addition, it is important that the metal oxide be substantially unreactive with the elastomer so that no substantial dehydrofluorination of the vinylidenefluoride in the polymer may take place. The preferred metal oxide is cupric oxide, which has been found to be a weak base and softened rather than hardened the elastomer with time thereby maintaining good copy quality and is typically present in an amount of from about 5 to 30 parts by weight per hundred parts of the polymer although it is preferred to have from about 10 to 20 parts by weight of metal oxide. In addition, the particle size of the metal oxide is important and it should not be so small as to interfere with the curing of the polymer nor so large as to supply an insufficient number of particles disbursed throughout the elastomer surface for good release properties. Typically, the average particle size was from about four to eight microns, preferably six microns.

Other adjuvents and fillers may be incorporated in the elastomer in accordance with the present invention as long as they do not effect the integrity of the elastomer, the interaction between the methyl oxide and the polymeric release agent having functional groups or prevent the appropriate crosslinking of the elastomer. Such fillers normally encountered in the compounding of elastomers include coloring agents, reinforcing fillers, crosslinking agents, processing aids, accelerators and polymerization initiators.

The surface of the fuser member of the present invention is preferably a roll, preferably one prepared by applying either in one application or successively applying to the surface to be coated thereon, a thin coating or coatings of the elastomer with metal oxide filler dispersed therein. Coating is most conveniently carried out by spraying, dipping, or the like a solution or homogeneous suspension of the elastomer containing the filler. While molding and extruding techniques are alternative means which may be used, we prefer to spray successive applications of a solvent solution of the polymer and metal oxide filler to the surface to be coated. Typical solvents that may be used for this purpose include acetone, methyl ethyl ketone, methyl isobutyl ketone and the like. When successive applications are made to the surface to be coated it is generally necessary to permit the film coated surface to stand at room temperature to flash off any solvent contained in the film. For example, when a fuser roll is coated with an elastomer layer containing metal oxide, the elastomer having metal oxide dispersed therein is successively applied to the roll in thin coatings and between each application evaporation of the solvent in the film coated on the roll is carried out at temperatures of at least 25° C. to about 90° C. or higher so as to flash off most of the solvent contained in the film. When the desired thickness of coating is obtained, the coating is cured and thereby bonded to the roll surface.

The adhesive layer is prepared by adding the coupling agent to the solution from which the fusing surface layer is prepared in an amount of from about 5 to about 20 per 100 parts by weight of the composition from which the fusing surface is cured. Typically, the coupling agent has the formula:

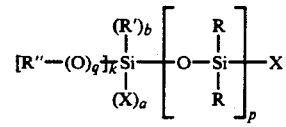

where R can be an alkyl having 1 to 4 carbon atoms; R′ can be an alkyl group having 1 to 7 carbon atoms; R″ can be H, R or the acyl radical,

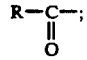

X is a vinyl group or an alkenyl group of 3 to 8 carbon atoms or an alkyl, 1 to 4 carbon atoms, substituted alkenylcarboxy group of less than 8 carbon atoms; and q is 1 or 2, k is 0 to 3, b is 0 to 2, a is 0 or 1, p is 0 to 20 and $k+b+a=3$. Particularly effective coupling agents include the silicone with vinyl functionality, Dow Corning 3-6060 previously discussed. Other suitable materials include vinylmethyldiethoxysilane, vinylmethyldiacetoxysilane, gamma-methacryloxypropyltrimethoxysilane, vinyltriethoxysilane, vinyltrimethoxysilane, vinyltris-t-butoxysilane, vinyltris (t-butylperoxy) silane, vinyltris (2-methoxyethoxy) silane, 3 acryloxypropyltrimethoxysilane and vinylsilanols containing up to 20 silanol units. The adhesive solution may be applied to the primer in any suitable way such as by dipping, spraying or brushing to a thickness of from about 5 to about 30 micrometers with a thickness of at least 7 micrometers being preferred, since below 7 micrometers adhesion may be compromised. While the mechanism by which the present adhesive layer provides a greater degree of bonding between the fluoroelastomer layer and silicone elastomer layer is not fully understood, it has been observed that this adhesive layer provides good adhesion at the time of manufacture as well as on aging and use even when processed at relatively humidities of from about 5 to 90 percent. Accordingly, it is believed that the coupling agent provides a reduction in sensitivity to relative humidity of the bond between the silicone elastomer layer and fluoroelastomer and thereby provides resistance to delamination.

A typical fuser member is prepared by molding or extruding an HTV silicone rubber heavily filled with conductive filler particles onto an aluminum core which has been degreased and surface roughened by grit blasting for example and primed with conventional primer as desired, followed by curing with no post cure. Afterwards, the surface of the elastomer may be roughened by grinding and degreased with alcohol such as isopropyl alcohol or a waterbased detergent. The amino silane primer such as a 5% solution of Union Carbide A 1100 in Isopropyl alcohol is brushed on the silicone elastomer and permitted to dry for up to 72 hours in a clean, up to 80 percent relative humidity environment. The adhesive and release layers are prepared by dissolving the polymer, metal oxide and inorganic base in a solvent overnight. For example, for the adhesive layer a hundred parts by weight of Viton GF, 15 parts by weight of cupric oxide, 2 parts by weight magnesium oxide and 1 part by weight of calcium hydroxide are added to methyl isobutyl ketone to provide a 12 percent solid solution (e.g. 50 grams of Viton GF and 367 grams of dry methyl isobutyl ketone). The adhesive is prepared by catalyzing 100 parts of the polymer solution with 4.2 parts of 12% DuPont Curative VC50 solution and mixing 100 parts of it with about 35 parts of the Dow Corning 3-6060. This mixture is shaken for one half hour on a paint shaker and air sprayed to a thickness of about 10 micrometers in at least 2 strokes at a gun to roll distance of about 4 inches after which it is permitted to dry for up to 24 hours in a clean environment at up to 80% relative humidity. The fusing surface layer is prepared the same way except that the solvent is a 50/50 percent by weight mixture of methylisobutylketone and methyl ethyl ketone which after being catalyzed with the DuPont VC50 solution is sprayed on the adhesive layer to a thickness of 40 micrometers. It is thereafter cured for a minimum of 4 hours at 120° Fahrenheit followed by a post cure of 4 hours at 120° F., 2 hours at 200° F., 2 hours at 300° F., 2 hours at 350° F., 2 hours at 400° F. and 11 hours at 450° F. to provide a 23 hour post cure and a final thickness between 30 and 65 micrometers.

The following examples further define and describe fuser members prepared by the present invention and illustrate further embodiment of the present invention. Unless otherwise indicated, all parts and percentages are by weight.

EXAMPLES

Six fuser rolls prepared according to the procedure outlined above were subjected to fixture testing in a fixture resembling that illustrated in FIG. 1 with toned images on ordinary paper in which the images were fused to the paper at a temperature of about 195° C. Testing was conducted on the rolls for between 90,000 and 170,000 fused copies without any failures due to adhesion. Testing was suspended or discontinued for other reasons. By comparison, the initially described fuser roll having the same fluoroelastomer fusing surface layer bonded directly to the HTV silicone elastomer layer exhibited an average failure at 20,000 fused copies by delamination of the fusing surface layer from the silicone elastomer layer although some rolls could be used for up to 90,000 copies prior to delamination failure.

Thus, according to the present invention an improved multilayer fuser member and fuser system have been provided. In particular, a fuser system with a fuser member having a very long life without delamination of the fusing surface layer from the thermally conductive silicone elastomer layer and one which is resistance to attack by DDAMS has been provided. This is enabled by a unique combination of a primer layer and an adhesive layer that dramatically improves the bonding between the conductive silicone elastomer layer and fluoroelastomer. In particular, the failure rate by delamination or by debonding is reduced even when the fusing member is manufactured or used in high relative humidity environment or used in a system where the toner contains the charge control agent DDAMS. This is achieved by providing an amino silane primer layer on the silicone elastomer layer and an adhesive layer which includes both the composition in the fusing surface layer as well as a coupling agent.

All the patents referred to herein are hereby specifically and totally incorporated by reference herein in their entirety in the instant specification.

While the invention has been described in detail with reference to specific and preferred embodiments, it will be appreciated that various modifications and variations will be apparent to the artisan. For example, while the invention has been illustrated with reference to a fuser roll, it will be understood that it has equal application to other fuser members such as flat or curved plate members in pressure contact with the roll. All such modifications and embodiments as may readily occur to one skilled in the art are intended to be within the scope of the appended claims.

We claim:

1. A multilayered fuser member for fusing thermoplastic resin toner images to a substrate in a fuser system of the type wherein a polymeric release agent having functional groups is applied to the surface of the fuser member, the fuser member comprising in sequential order a base support member, a thermally conductive silicone elastomer layer, an amino silane primer layer, an adhesive layer and an elastomer fusing surface comprising poly(vinylidenefluoride-hexafluoropropylene-tetrafluoroethylene) where the vinylidenefluoride is present in an amount less than 40 mole percent, a metal oxide present in said fusing surface in an amount sufficient to interact with a polymeric release agent having functional groups to provide an interfacial barrier layer between said fusing surface and said toner and being substantially unreactive with said elastomer, said elastomer fusing surface having been cured from a solvent solution thereof with a nucleophilic curing agent soluble in said solution and in the presence of less than 4 parts by weight of inorganic base per 100 parts of polymer, said inorganic base being effective to at least partially dehydrofluorinate the vinylidenefluoride, said adhesive layer having been cured from a solvent solution of the above composition from which said elastomer fusing surface is cured and from about 5 to about 10% by weight of said composition of a coupling agent represented by the formula:

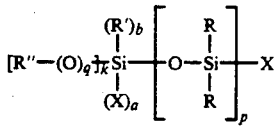

where R can be an alkyl having 1 to 4 carbon atoms; R' can be an alkyl group having 1 to 7 carbon atoms; R'' can be H, R or the acyl radical,

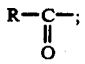

X is a vinyl group or an alkenyl group of 3 to 8 carbon atoms or an alkyl, having 1 to 4 carbon atoms, substituted alkenylcarboxy group of less than 8 carbon atoms; and q is 1 or 2, k is 0 to 3, b is 0 to 2, a is 0 or 1, p is 0 to 20 and k+b+a=3.

2. The fuser member of claim 1 wherein said amino silane is represented by the formula:

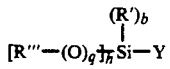

where R' can be an alkyl group having 1 to 7 carbon atoms; R''' can be an alkyl group having 1 to 7 carbon atoms or a polyalkoxyalkyl group of less than 7 carbon atoms; Y is an amino group or an amino substituted alkyl, or a polyamino substituted alkyl, or an alkenylalkoxy amino, or an aryl amino group of less than 15 carbon atoms, h is 1 to 3, b is 0 to 2, q is 1 or 2 and h+b=3.

3. The fuser member of claim 2 wherein said amino silane is selected from the group consisting of gamma-aminopropyl triethoxysilane.

4. The fuser member of claim 1 wherein said amino silane primer is applied to said silicone elastomer by brushing, dipping or spraying.

5. The fuser member of claim 1 wherein said coupling agent is a silicone with vinyl functionality.

6. The fuser member of claim 1 wherein the adhesive layer is from about 5 to about 30 micrometers thick.

7. The fuser member of claim 1 wherein the inorganic base is magnesium oxide present in an amount of about 2 parts by weight per 100 parts of polymer.

8. The fuser member of claim 1 wherein the fusing surface layer is from about 30 to about 65 micrometers thick.

9. The fuser member of claim 1 wherein the metal oxide is cupric oxide which is present in amount of from about 5 to 30 parts by weight per 100 parts by weight of polymer.

10. The fuser member claim 1 wherein the silicone elastomer is a cured polydimethylsiloxane having the formula:

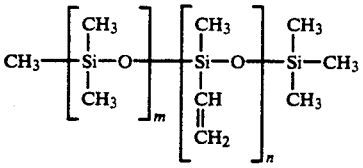

where $0<(n/m)\leqq 0.2$ and m+n is 3,000 to 10,000.

11. The method of fusing thermoplastic resin toner images to a substrate comprising forming a film of a polymeric release agent having functional groups on the surface of a heated fuser member, said fuser member comprising in sequential order a base support member, a thermally conductive silicone elastomer layer, an amino silane primer layer, an adhesive layer and an elastomer fusing surface comprising poly(vinylidenefluoride-hexafluoropropylene-tetrafluoroethylene) where the vinylidenefluoride is present in an amount less than 40 mole percent, a metal oxide present in said fusing surface in an amount sufficient to interact with a polymeric release agent having functional groups to provide an interfacial barrier layer between said fusing surface and said toner and being substantially unreactive with said elastomer, said elastomer fusing surface having been cured from a solvent solution thereof with a nucleophilic curing agent soluble in said solution and in the presence of less than 4 parts by weight of inorganic base per 100 parts of polymer, said inorganic base being effective to at least partially dehydrofluorinate the vinylidenefluoride, said adhesive layer having been cured from a solvent solution of the above composition from which said elastomer fusing surface is cured and from about 5 to about 20% by weight of said composition of a coupling agent represented by the formula:

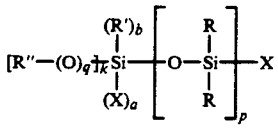

where R can be an alkyl having 1 to 4 carbon atoms; R' can be an alkyl group having 1 to 7 carbon atoms; R'' can be H, R or the acyl radical,

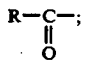

X is a vinyl group or an alkenyl group of 3 to 8 carbon atoms or an alkyl, having 1 to 4 carbon atoms, substituted alkenylcarboxy group of less than 8 carbon atoms; and q is 1 or 2, k is 0 to 3, b is 0 to 2, a is 0 or 1, p is 0 to 20 and k+b+a=3.

12. The method of claim 11 wherein said amino silane is represented by the formula:

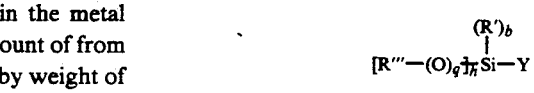

where R' can be an alkyl group having 1 to 7 carbon atoms; R''' can be an alkyl group having 1 to 7 carbon atoms or a polyalkoxyalkyl group of less than 7 carbon atoms; Y is an amino group or an amino substituted alkyl, or a polyamino substituted alkyl, or an alkenylalkoxy amino, or an aryl amino group of less than 15 carbon atoms, h is 1 to 3, b is 0 to 2, q is 1 or 2 and h+b=3.

13. The method of claim 12 wherein said amino silane is selected from the group consisting of gamma-aminopropyl triethoxysilane.

14. The method of claim 11 wherein said amino silane primer is applied to said silicone elastomer by brush.

15. The method of claim 11 wherein said coupling agent is a silicone with vinyl functionality.

16. The method of claim 11 wherein the adhesive layer is from about 5 to about 30 micrometers thick.

17. The method of claim 11 wherein the inorganic base is magnesium oxide present in an amount of about 2 parts by weight per 100 parts of polymer.

18. The method of claim 11 wherein the fusing surface layer is from about 30 to about 65 micrometers thick.

19. The method claim 11 wherein the metal oxide is cupric oxide which is present in an amount of from about 5 to 30 parts by weight per 100 parts by weight of polymer.

20. The method claim 11 wherein the silicone elastomer is a cured polydimethylsiloxane having the formula:

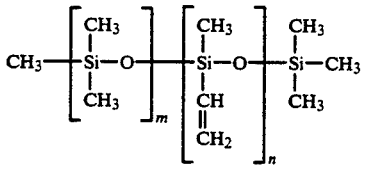

where $0<(n/m)\leqq 0.2$ and $m+n$ is 3,000 to 10,000.

* * * * *